United States Patent [19]

Schwarz

[11] Patent Number: 5,039,902

[45] Date of Patent: Aug. 13, 1991

[54] OVERHEAD STORAGE SYSTEM

[76] Inventor: Fred M. Schwarz, 162 Butler Dr., Glastonbury, Conn. 06033

[21] Appl. No.: 376,371

[22] Filed: Jul. 6, 1989

[51] Int. Cl.[5] ..... A47F 5/08

[52] U.S. Cl. ..... 312/245; 248/318; 248/320; 206/806

[58] Field of Search ..... 248/320, 321, 322, 306, 248/201, 202.1, 318; 312/345, 245, 248; 206/806; 211/113, 115, 116

[56] References Cited

U.S. PATENT DOCUMENTS

| | | | |
|---|---|---|---|
| 1,529,199 | 3/1925 | McNelly | 248/320 |
| 3,331,645 | 7/1967 | Vercellotti | 312/248 |
| 3,452,957 | 7/1969 | Zuelsdorf | 248/318 |
| 3,485,544 | 12/1969 | Beckerman | 312/248 |
| 3,752,551 | 8/1973 | Clark | 312/245 |
| 3,822,049 | 7/1974 | Saunders | 248/203 |
| 3,846,005 | 11/1974 | Harper et al. | 312/248 |
| 4,275,942 | 6/1981 | Steidl | 32/266 |
| 4,446,660 | 5/1984 | Miller et al. | 52/36 |
| 4,699,437 | 10/1987 | Genereaux | 312/248 |
| 4,733,925 | 3/1988 | Duran et al. | 312/248 |

*Primary Examiner*—Kenneth J. Dorner
*Assistant Examiner*—Gerald A. Anderson
*Attorney, Agent, or Firm*—Ira S. Dorman

[57] ABSTRACT

An overhead storage system utilizes a bin having handles that are engaged by fixtures, at least one of which is articulated to permit facile emplacement of the bin and ready access thereto when desired. The fixtures cooperate with the handle structure to provide lateral and longitudinal stability, as well as underlying support for the container.

9 Claims, 3 Drawing Sheets

OVERHEAD STORAGE SYSTEM

BACKGROUND OF THE INVENTION

The prior art has recognized the desirability of utilizing the space that is present between structural members of buildings, such as joists and studs for storage purposes. The following U.S. patents disclose arrangements by which containers of various kinds may be mounted between such structural members: Vercellotti No. 3,331,645, issued July 18, 1967; Miller et al No. 4,446,660, issued May 8, 1984; and Genereaux No. 4,699,437, issued Oct. 13, 1987. Suspended storage units and shelves are also shown in the following U.S. Pat. Nos.: Beckerman No. 3,485,544, issued Dec. 3, 1969; Harper et al No. 3,846,005, issued Nov. 5, 1974; Steidl No. 4,275,942, issued June 30, 1981; and Duran et al No. 4,733,925, issued Mar. 29, 1988.

Despite the activity in the art exemplified by the foregoing, a need remains for an overhead storage system which is highly secure and convenient to utilize, and which consists of components that are of relatively uncomplicated construction, and that are facile and inexpensive to manufacture and install. Accordingly, it is the primary object of the present invention to provide a novel overhead storage system having the foregoing features and advantages.

An ancillary object is to provide such a system which employs a container that is of conventional construction, and that is suited for use by itself for purposes other than in the instant system.

SUMMARY OF THE INVENTION

It has now been found that the foregoing and related objects of the invention are readily attained by the provision of an overhead storage system comprising a bin having handle structure on its opposite end portions, and a pair of fixtures adapted to support the bin from above. The fixtures have means for engaging the handle structure of the bin to provide underlying support, and endwise and lateral stability, and at least one of the fixtures comprises a latch member that is pivotably mounted on a mounting member. Means is provided on the latch member and the bin handle structure for cooperatively deflecting the latch member from its normal, depending position When the handle structure is elevated against it, ®nd the fixture is adapted to effect return of the latch member toward its depending position for engagement of the handle structure.

Generally, the handle structure of the bin will define a downwardly opening recess, and the means on the fixtures for engaging the handle structure will comprise an upwardly projecting element that is dimensioned and configured to seat within the handle structure recess. In the preferred embodiments the engaging means provided on at least one of the fixtures will comprise a pair of lateral elements disposed to opposite sides of the projecting element and so spaced from one another as to receive the handle structure therebetween. The deflecting means will desirably comprise at least one camming element configured to pivot the latch member away from the bin, in slidable engagement with the handle structure, and to permit return toward its normal position when the projecting element is in substantial horizontal alignment with the handle structure recess, for entry thereinto. Generally, the latch member will be suspended from the mounting member to hang naturally in its normal position.

The bin and latch member will most desirably have elements that are adapted for operative interconnection, so as to affix the latch member in its position of engagement with the handle structure. The interconnecting elements may comprise a bracket on the bin and a flange on the latch member, the elements having apertures that are disposed to register with one another, when the latch member is in its position of engagement with the handle structure, so as to receive a locking pin or the like therethrough.

DETAILED DESCRIPTION OF THE ILLUSTRATED EMBODIMENT

Figure 1:
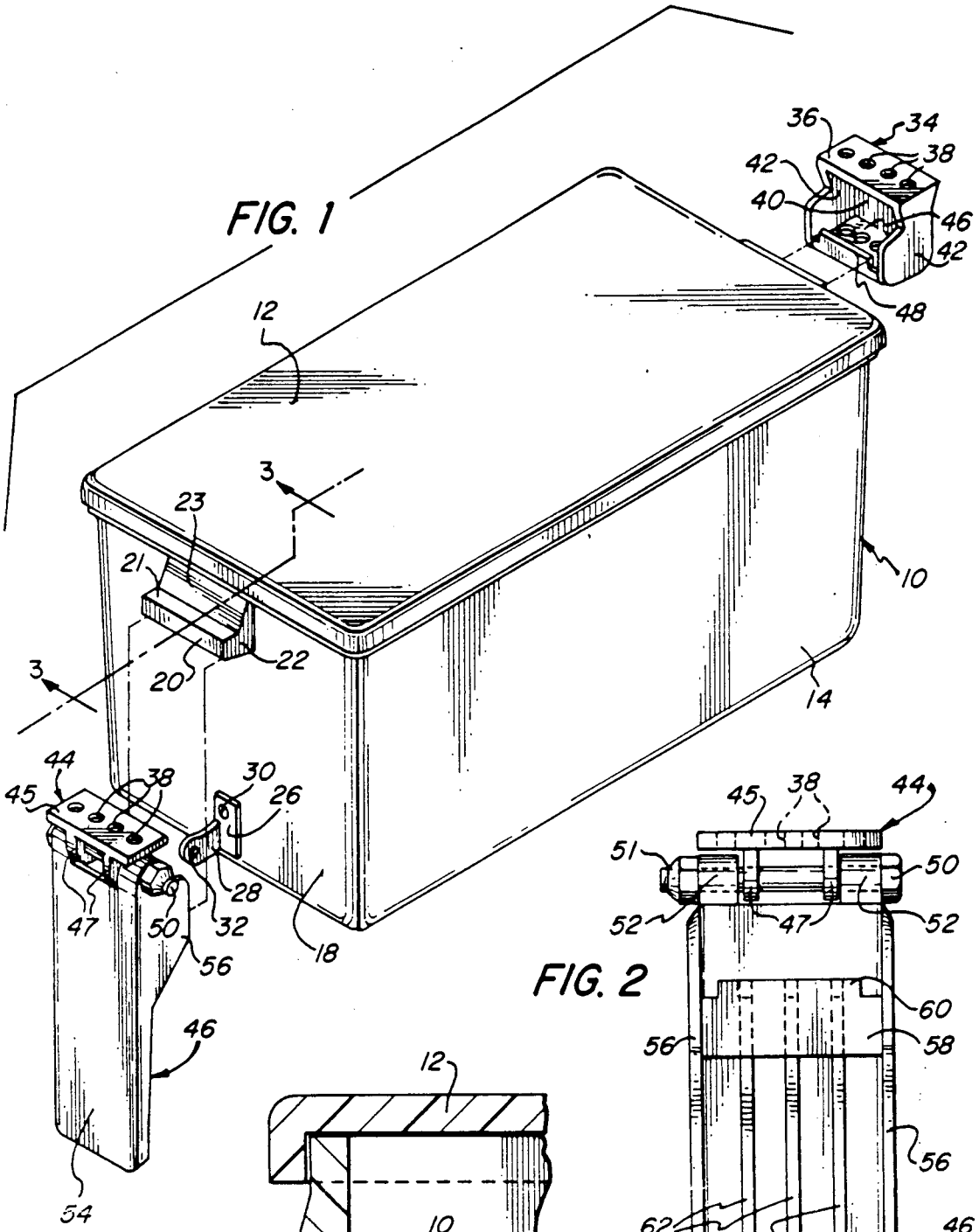
FIG. 1 is an exploded perspective view showing the storage system of the invention.
Figure 2:
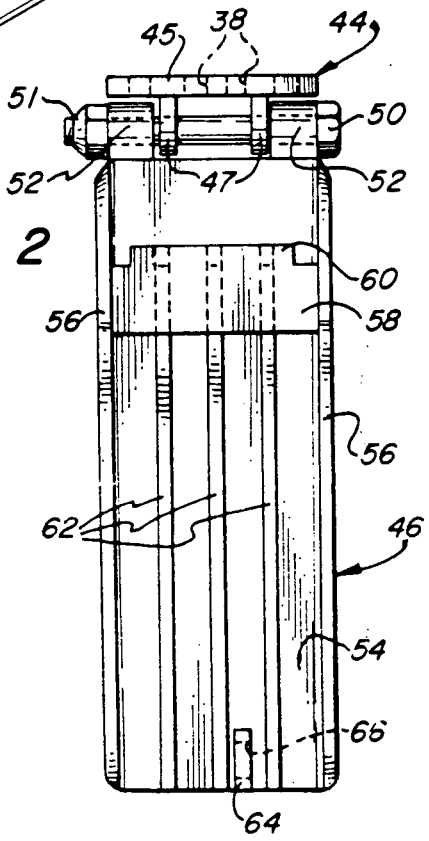
FIG. 2 is an elevational view of the articulated fixture employed in the system of FIG. 1, taken from the inwardly facing side thereof.
Figure 3:
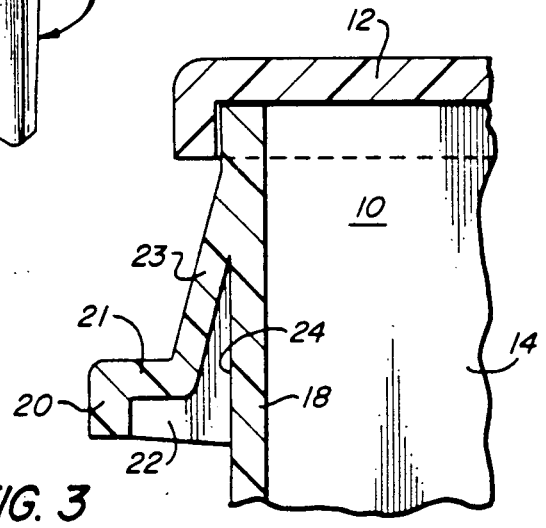
FIG. 3 is a fragmentary sectional view, taken along line 3—3 of FIG. 1 and drawn to an enlarged scale.

Turning now in detail to the appended drawings, therein illustrated is a system embodying the present invention and including a bin, generallY designated by the numeral 10, having a flanged cover seated thereupon. The bin 10 is of a generally conventional construction, consisting of sidewalls 14, a bottom Wall 16 and end Walls 18, as may readily be molded from a synthetic resinous material. Handles are formed near the top of both of the end panels 18, each handle including forward, upper, and inclined wall portions 20, 21, and 23, and lateral wall portions 22, which cooperatively define an interior space 24 therewithin to facilitate gripping, as is of course entirelY conventional.

The bin shown is modified by the addition of a small bracket adjacent the bottom of one of its end walls 18. The bracket consists of a mounting plate portion 26 and a perpendicular flange portion 28, the plate being secured to the wall 18 by a fastener 30 and the flange 28 having an aperture 32 adjacent its free outer end.

Figure 4:
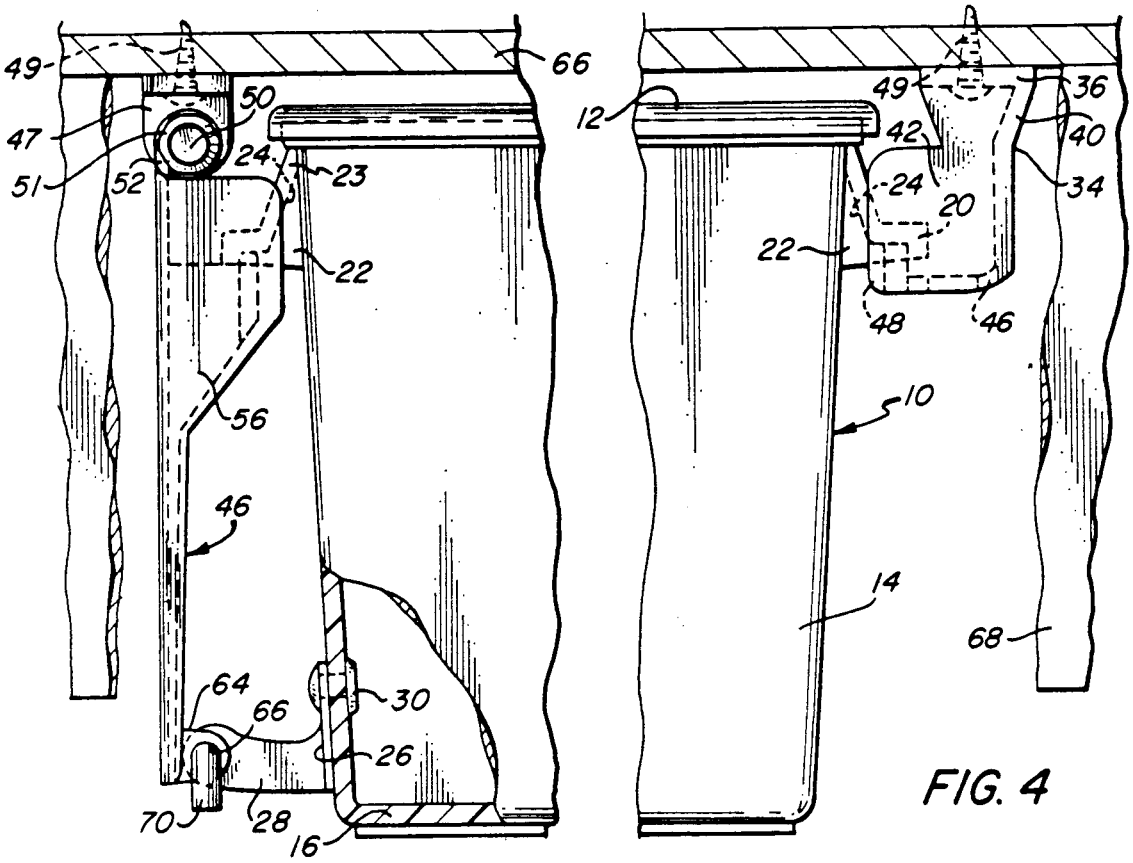
FIG. 4 is a fragmentary side view, in partial section, showing the system of the invention installed between overhead joists.
Figure 5:
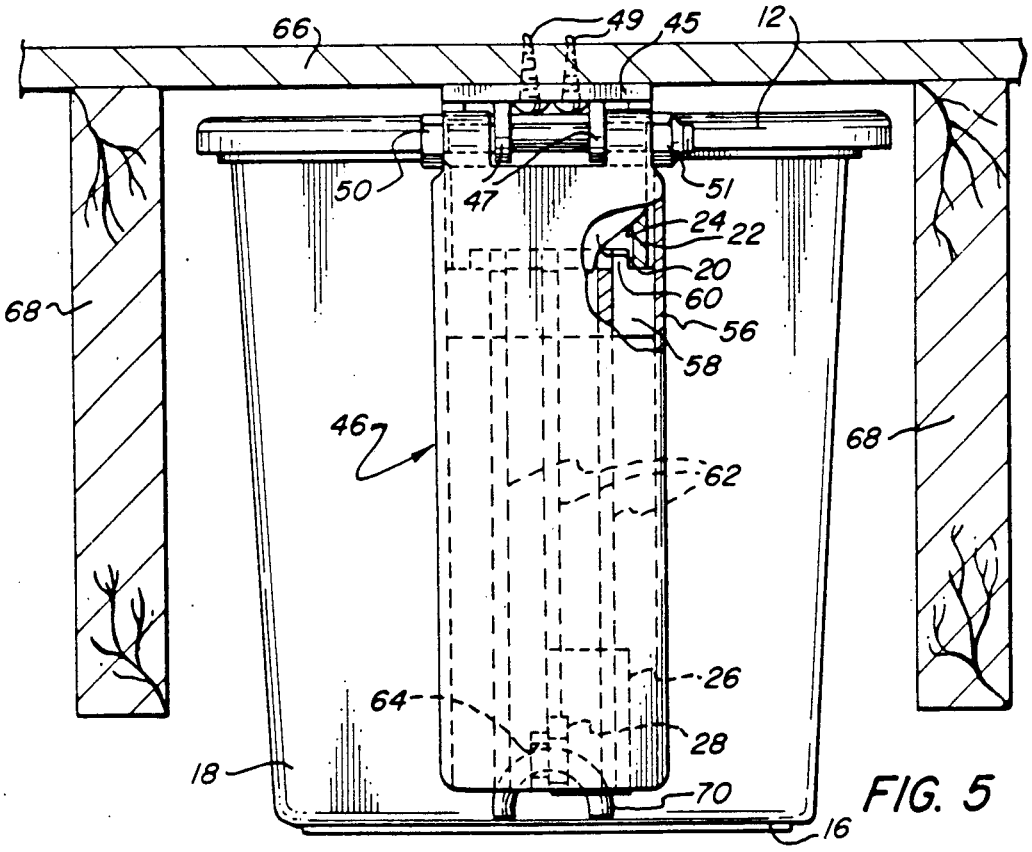
FIG. 5 is a fragmentary end view, in partial section, showing the installed system of FIG. 4.
Figure 6:
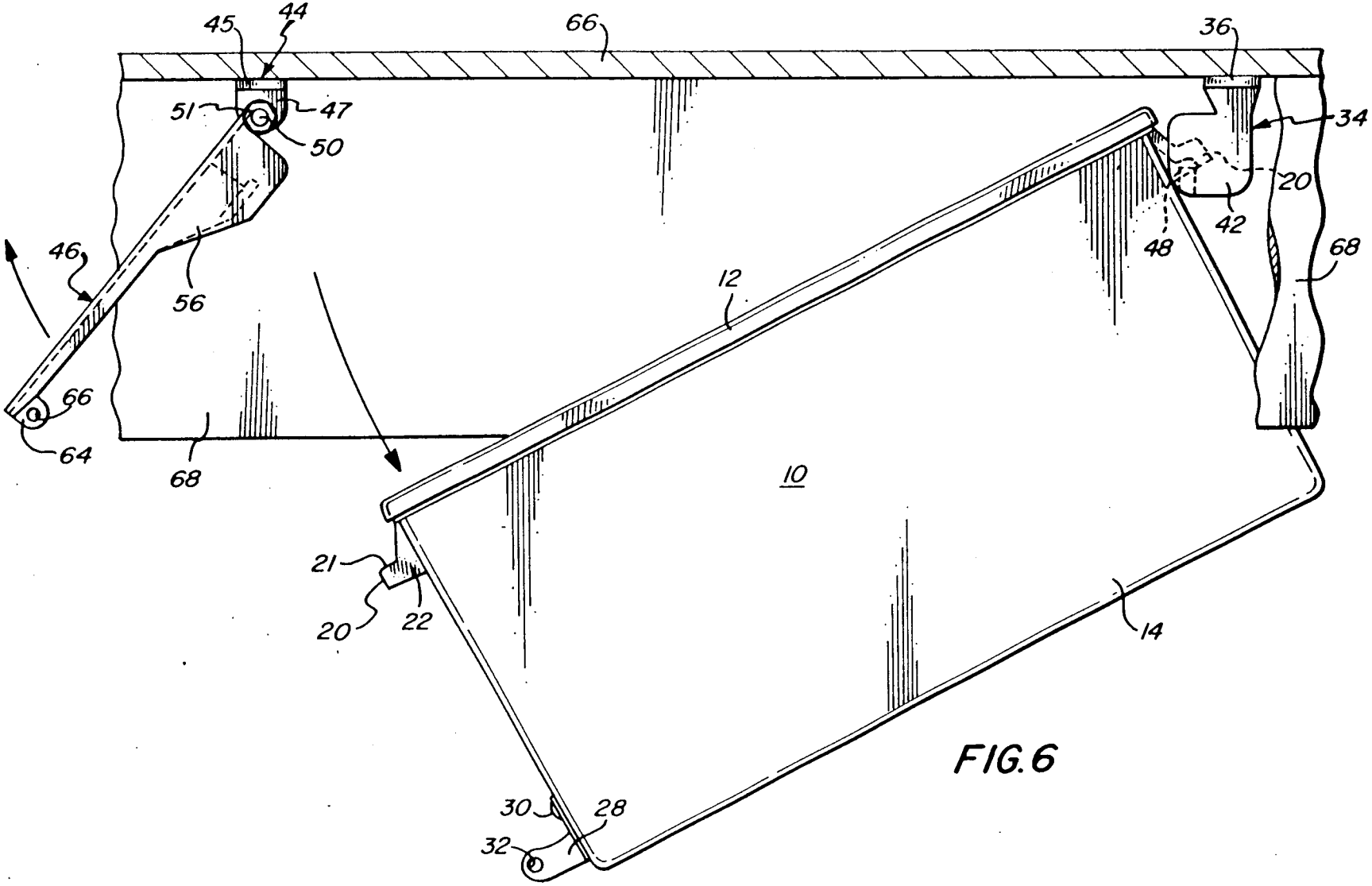
FIG. 6 is a side view showing outward pivoting of the latch member of the articulated fixture utilized in the system, with removal of the bin.

One of the fixtures of which the system is comprised is generally designated by the numeral 34, and may consist of a single piece of metal formed to provide the component portions; i.e., top wall 36, back wall 40, lateral walls 42, bottom wall 46, and a short front wall with an upwardly projecting lip 48 of reduced axial length. As seen in FIGS. 4–6, the bracket 34 is adapted for installation against the underside of floorboards, ceiling panels, or the like, as by use of screws 49 received Within holes 38 in its top wall portion 36.

The other fixture is an articulated assembly consisting of a mounting bracket, generally designated by the numeral 44, and a latching arm generally designed by the numeral 46. The bracket 44 includes a mounting plate portion 45 formed with holes 38, and a pair of spaced ears 47 having apertures (unnumbered) through Which a bolt 50 extends. The bolt 50, secured in place by the threadably engaged nut 51, serves to pivotablY support the latching arm 46, the panel 54 of which is formed at its upper end with tubular elements 52 for hinged assembly.

The panel 54 is also formed with lateral wing portions 56 extending along its opposite side margins between which a plate 58, having an upper edge lip portion 60 of reduced axial length thereon, is secured against the inner surface of the panel 54. Three parallel rib formations 62 extend longitudinally along the inner surface of the panel 54, and lead from adjacent the lower end thereof to a location proximate the edge of the lip portion 60; the profile of the formations 62 corresponds to that of the wing portions 56. A small tab 64 projects inWardly from the loWer end of the arm panel 54, and is formed With an aperture 66.

As will be noted from FIGS. 4–6, both of the fixtures of the system are installed by use of screws 49 against overhead structural member 66 between adjacent joists 68; access openings (unnumbered) are provided in the bottom wall portion 46 of the bracket 34 to facilitate screw insertion. In preferred embodiments, the container will be dimensioned and configured to fit conveniently within the space defined; however, it will be appreciated that the system may also be utilized in other environments if so desired.

The container of the system is emplaced simply by engaging one of the handles of the bin 10 on the lip portion 48 of the fixed bracket 34, and thereafter elevating its opposite end. As the bin is raised the outer surface of the other handle will be come to bear upon the edge surfaces of the rib formations 62 on the inside of the panel 54, thereby causing the arm 46 to pivot outwardly about the mounting bolt 50. When the handle reaches a level above the lip portion 60 of the plate 58, the latching arm 46 will swing inwardly under its own weight, therebY permitting the lip portion to enter and to seat within the internal space 24 defined by wall portions 20, 21 and 22.

When the bin 10 has been so positioned the arm 46 may be adjusted (if necessary) to align the aperture 66 in its ear 64 with the aperture 32 in the flange 28, thus enabling insertion o: the U-shaped pin 70. This will of course lock the arm in position relative to the bin and Will in turn positively secure the bin in place With its handles trapped between the lateral portions 42, 56 on the fixture 34 and latching arm 46, respectively, and With the tongue portions 48, 60 engaged between the lateral Wall portions 22 on the inside of the handles and under the wall portions 20 and 21 thereof. The container Will thus be securely mounted against disengagement in all directions, and it will be appreciated that clearances between the handles and the fixture elements may be minimized for greatest security, consistent of course with convenience of bin emplacement.

Removal of the container is achieved simplY bY outward displacement of the latching arm 46, as indicated by the arrow in FIG. 6; it will of course be evident that the bin will first be elevated slightly to disengage the lip portion 60 from under the handle. The container can then be pivoted downwardly, and finally lifted away from the fixture 34.

It will be appreciated that the components of the system of the invention may vary considerably from those of the illustrated embodiment without departing from the concept of the invention or the scope of the claims. For example, there is little limitation upon the form or dimensions of the bin, albeit that the general configuration shown may be optimal from the standpoint of providing a unit that is suited for facile emplacement between building joists. Also, and as noted above, while it will usually be advantageous to mold the bin and its cover from a synthetic resinous material, other materials and forms of construction may certainly be substituted, as appropriate.

The fixtures utilized to suspend the bin may similarly take any of a wide variety of different forms and constructions, provided of course that they are capable of providing adequate support in engagement with the handle structure. Although the system illustrated utilizes one fixed and one articulated supporting fixture, it should be understood that both of the fixtures may employ relatively movable parts if so desired. Moreover, While the pivoted arm of the articulated fixture depicted hangs naturally under the force of gravity, in some instances it may be desirable to spring-load the arm so as to cause it to positively return to a vertical orientation, or indeed to an orientation therebeyond.

Thus, it can be seen that the present invention provides a novel overhead storage system which is highly secure and convenient to utilize, and which consists of components that of relatively uncomplicated construction, and are facile and inexpensive to manufacture and install. The container utilized in the sYstem maY be of entirely conventional construction, end may be suitable for use by itself, for purposes other than in the instant system.

Having thus described the invention, what is claimed is:

1. An overhead storage system comprising:

a bin having opposite end portions, each having handle structure, with a downwardly opening recess, for manually transporting said bin; and a pair of fixtures, each having means for engaging one of said handle structures to provide underlying support, and endwise and lateral stability, for said bin, at least a first of said fixtures comprising a latch member, providing said means for engaging one of said handle structures, and a mounting member for attachment to overhead structure and pivotably mounting said latch member in a depending, normal position when so attached, said means for engaging, that is present on at least said latch member, including an underlying engagement element projecting upwardly, in said normal position of said first fixture, and being devoid of any cooperating engagement element disposed, in said normal position, over said underlying element, said engagement element being dimensioned and configured for seated engagement within said recess of said one handle structure, and said means for engaging that is present on at least said latch member comprising a pair of lateral elements disposed to opposite sides of said underlying engagement element, said lateral elements being so spaced from one another as to receive said one handle structure between them, in seated engagement with said underlying engagement element, said latch member and said one handle structure having means thereon for cooperatively deflecting, by mutual contact, said latch member from its normal position to permit passage of said one handle structure by said underlying engagement element when said one handle structure is elevated against said latch member, said first fixture being adapted to effect return of said latch member toward said normal position after such passage occurs, so as to cause said means for engaging to so engage within said recess of said one handle structure.

2. The system of claim 1 wherein said means for engaging, present on each of said fixtures, comprises an underlying engagement element projecting upwardly on each of said fixtures being dimensioned and configured for seated engagement within one of said handle structure recesses.

3. The system of claim 1 wherein said means for deflecting comprises at least one camming element on said latch member configured to effect pivoting of said latch member away from said bin in slidable engagement with said one handle structure of said bin, said camming element configuration permitting return of said latch member toward said normal position when said underlying engagement element on said latch member is in general horizontal alignment with said one handle structure recess for entry into it.

4. The system of claim 1 wherein the other of said fixtures is devoid of relatively movable parts.

5. The system of claim 1 wherein said latch member is suspended by said mounting member to hang naturally in said normal position thereof.

6. The system of claim 1 wherein said bin and said latch member have elements on them disposed for operative interconnection for affixing said latch member in its position of engagement with said handle structure.

7. The system of claim 6 wherein said elements disposed for interconnection comprise a bracket on said bin and a flange on said latch member, both said bracket and said flange having portions with apertures through them disposed to register with one another when said latch member is in said position of engagement.

8. The system of claim 7 additionally including a locking element engaged in said apertures of said bracket and flange portions.

9. An overhead storage system comprising:

a bin having opposite end portions, each having handle structure for manually transporting said bin;

a pair of fixtures, each having means for engaging one of said handle structures to provide underlying support, and endwise stability for said bin, at least a first of said fixtures comprising a latch member, providing said means for engaging one of said handle structures, and a mounting member for attachment to overhead structure and pivotably mounting said latch member in a depending, normal position when so attached, said means for engaging, that is present on at least said latch member, including an underlying engagement element projecting upwardly, in said normal position of said first fixture, and being devoid of any cooperating engagement element disposed, in said normal position, over said underlying element, said latch member and said one handle structure having means thereon for cooperatively deflecting, by mutual contact, said latch member from its normal position to permit passage of said one handle structure by said underlying engagement element when said one handle structure is elevated against said latch member, said first fixture being adapted to effect return of said latch member toward said normal position after such passage occurs, so as to cause said means for engaging to so engage said one handle structure, said bin and said latch member having affixing elements disposed for operative interconnection for affixing said latch member in its position of engagement with said one handle structure, said affixing elements comprising a bracket disposed on said bin below said one handle structure, and a flange disposed on said latch member below said means for engaging present thereon, both said bracket and said flange having portions with apertures through them disposed to register with one another when said latch member is in said position of engagement; and a locking element engaged in said apertures of said bracket and flange portions.

* * * * *